US010508859B2

(12) United States Patent
Cao et al.

(10) Patent No.: US 10,508,859 B2
(45) Date of Patent: Dec. 17, 2019

(54) PROCESS FOR INCREASING LOW PRESSURE PURE NITROGEN PRODUCTION BY REVAMPING ORIGINAL APPARATUS FOR CRYOGENIC AIR SEPARATION

(71) Applicant: L'Air Liquide, Societe Anonyme pour l'Etude et l'Exploitation des Procedes Georges Claude, Paris (FR)

(72) Inventors: Jian-Wei Cao, Hangzhou (CN); Xin Zhao, Hangzhou (CN)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 199 days.

(21) Appl. No.: 15/817,977

(22) Filed: Nov. 20, 2017

(65) Prior Publication Data

US 2018/0149426 A1 May 31, 2018

(30) Foreign Application Priority Data

Nov. 25, 2016 (CN) ..... 2016 1 1053706

(51) Int. Cl.
*F25J 3/04* (2006.01)

(52) U.S. Cl.
CPC ..... *F25J 3/04412* (2013.01); *F25J 3/0409* (2013.01); *F25J 3/0423* (2013.01); (Continued)

(58) Field of Classification Search
CPC ..... F25J 3/04; F25J 2200/04; F25J 2200/06; F25J 2200/08; F25J 2200/10; (Continued)

(56) References Cited

U.S. PATENT DOCUMENTS

2007/0000282 A1* 1/2007 Tranier ..... F01D 25/16 62/621
2010/0037656 A1* 2/2010 Prosser ..... F25J 3/0409 62/643

(Continued)

FOREIGN PATENT DOCUMENTS

CN 103 277 981 9/2013

*Primary Examiner* — Frantz F Jules
*Assistant Examiner* — Erik Mendoza-Wilkenfel
(74) *Attorney, Agent, or Firm* — Justin K. Murray

(57) ABSTRACT

The object of the present invention is to provide a different solution for revamping existing producing apparatuses so as to increase the production of low pressure pure nitrogen while controlling as far as possible the capital and operation expenditures. The revamping solution comprises increasing the diameter and/or height of a pure nitrogen column to thereby improve the production capacity thereof; choosing to switch the conduits where the waste liquid nitrogen and pure liquid nitrogen are passed through in the subcooler according to the increment of the low pressure pure nitrogen production; adding an additional heat exchanger to conduct a heat exchange between a portion of the medium pressure air and the increased low pressure pure nitrogen; or simultaneously switching the main parts of the conduits which transfer the pure liquid nitrogen and waste liquid nitrogen from a first column of higher pressure to a second column of lower pressure while performing the above revamping. The stepwise revamping solution of the present invention can be used not only to control the cost but also increase the low pressure pure nitrogen production while ensuring a stable operation of the air separation unit.

7 Claims, 3 Drawing Sheets

(52) U.S. Cl.
CPC ..... *F25J 3/04024* (2013.01); *F25J 3/04218* (2013.01); *F25J 3/04303* (2013.01); *F25J 3/04315* (2013.01); *F25J 3/04787* (2013.01); *F25J 3/04969* (2013.01); *F25J 2200/06* (2013.01); *F25J 2210/40* (2013.01); *F25J 2215/44* (2013.01)

(58) Field of Classification Search
CPC .. F25J 2200/54; F25J 2215/42; F25J 2215/44; F25J 3/04406; F25J 3/04412; F25J 3/04418; F25J 3/0443; F25J 3/04969; F25J 2280/02; F25J 2280/10; F25J 2280/20; F25J 2290/34; F25J 2290/80
See application file for complete search history.

(56) References Cited

U.S. PATENT DOCUMENTS

2011/0259046 A1* 10/2011 Bachelier ..... F25J 3/0409 62/643
2013/0255924 A1* 10/2013 Dietrich ..... F28D 9/0068 165/167

* cited by examiner

PROCESS FOR INCREASING LOW PRESSURE PURE NITROGEN PRODUCTION BY REVAMPING ORIGINAL APPARATUS FOR CRYOGENIC AIR SEPARATION

CROSS REFERENCE TO RELATED APPLICATIONS

This application claims the benefit of priority under 35 U.S.C. § 119 (a) and (b) to Chinese patent application No. CN2016/11053706.X, filed Nov. 25, 2016, the entire contents of which are incorporated herein by reference.

FIELD OF THE INVENTION

The present invention relates to a process and an apparatus for the separation of air by cryogenic distillation.

BACKGROUND

In recent years, because of product adjustment, some metallurgical enterprises, iron and steel enterprises have substantially increased the demand for low pressure pure nitrogen production while maintaining the requirement for pure oxygen and/or pure liquid oxygen production. It is very common to produce such products as pure oxygen, pure liquid oxygen, low pressure pure nitrogen and waste nitrogen in two pressure columns for the separation of air via a process for the separation of air by cryogenic distillation. Moreover, the proportion of each product is determined by the designed air separation column, and will not make a very big difference during operation.

If it is intended to increase the low pressure pure nitrogen production significantly in the existing air separation unit, the general practice comprises a) replacing the old air separation unit with a new air separation unit which would, however, greatly increase the capital expenditures and waste the old air separation unit; b) investing in a new apparatus for purifying waste nitrogen to produce low pressure pure nitrogen, which would, however, increase both the capital and operation expenditures.

Thus, it is beneficial to revamp the original air separation unit to thereby increase the production of low pressure pure nitrogen.

CN103277981B discloses an apparatus and a method for increasing the ratio of nitrogen to oxygen products in an air separation unit. By omitting the auxiliary column mounted on the original upper column, the original upper column is heightened by 30%, and by switching the conduits for transporting the nitrogen and waste nitrogen produced from the upper column, the ratio of nitrogen to oxygen products increases from 1:1 to 2:1. However, this disclosure only aims at specific yield changes, and does not take into consideration the equilibrium of each stream in the subcooler and the flux of other conduits, thus is not universally applicable.

SUMMARY OF THE INVENTION

An object of the present invention is to provide a different solution for revamping existing producing apparatuses according to the requirement on increasing low pressure pure nitrogen production while controlling as far as possible the capital and operation expenditures.

According to an object of the invention, there is provided a process of revamping an original apparatus for the separation of air by cryogenic distillation so as to increase the production of low pressure pure nitrogen, the original apparatus for the separation of air by cryogenic distillation comprising:

a) a first column operated under a first pressure and a second column operated under a relatively lower second pressure, a condensation evaporator disposed on top of the first column and an original pure nitrogen column connected to the top of the second column and having a smaller diameter than the second column, b) a main compressor, an air purification and cooling system, a main heat exchanger, an expander and a conduit conveying system for compressing, purifying, and cooling the feed air, and transferring it to at least the first column, c) a subcooler for indirect heat exchange between fluids to be cooled which are the oxygen enriched liquid air, original waste liquid nitrogen and original pure liquid nitrogen produced from the first column and possibly pure liquid oxygen from the second column and fluids to be warmed which are the original low pressure pure nitrogen and original waste nitrogen produced from the second column, the subcooler comprising a first group of passages through which the original waste liquid nitrogen is passed and a second group of passages through which the original pure liquid nitrogen is passed, and the total heat exchange area of the first group of passages being greater than the total heat exchange area of the second group of passages, d) a conduit having a diameter D that transfers the original waste liquid nitrogen from the first column to the first group of passages in the subcooler and a conduit having a diameter D' that transfers the cooled original waste liquid nitrogen from the first group of passages in the subcooler to the upper part of the second column as well as a conduit having a diameter d that transfers the original pure liquid nitrogen from the first column to the second group of passages in the subcooler and a conduit having a diameter d' that transfers the cooled original pure liquid nitrogen from the second group of passages in the subcooler to the top of original pure nitrogen column, wherein $D>d$, $D'>d'$, e) increasing the diameter and/or height of the original pure nitrogen column to thereby improve the production capacity of the low pressure pure nitrogen in the revamped pure nitrogen column and/or installing an additional pure nitrogen column in parallel to the original pure nitrogen column in order to improve the overall production capacity;

f) switching the conduits having diameters D and d at the hot end of the subcooler, switching the conduits having diameters D' and d' at the cold end of the subcooler, allowing the pure liquid nitrogen after revamping to be passed through the first group of passages in the subcooler, and the waste liquid nitrogen after revamping to be passed through the second group of passages in the subcooler.

According to an optional variant, the process may further comprise:

a) adding an additional heat exchanger, b) dividing the low pressure pure nitrogen after revamping that has been warmed in the subcooler into two portions, with the first portion entering the cold end of the original main heat exchanger and the second portion entering the cold end of the additional heat exchanger, and also dividing the pressurized and purified air into two portions, with the first portion entering the hot end of the original main heat exchanger and the second portion entering the hot end of the additional heat exchanger, and being respectively subjected to indirect heat exchange with the first and second portions of the low pressure pure nitrogen after revamping.

The process may further comprise switching the conduits for transporting the pure liquid nitrogen after revamping and waste liquid nitrogen after revamping, such that:

a) the waste liquid nitrogen from the first column after revamping is passed successively through the conduit having a diameter D, the conduit having a diameter d, the second group of passages in the subcooler, the conduit having a diameter d', a first throttle valve, the conduit having a diameter D', and finally to the upper part of the second column, b) the pure liquid nitrogen from the first column after revamping is passed successively through the conduit having a diameter d, the conduit having a diameter D, the first group of passages in the subcooler, the conduit having a diameter D', a second throttle valve, the conduit having a diameter d', and finally to the top of the pure nitrogen column.

The conduits may be switched at a distance of not less than 100 mm away from the outer surfaces of the first and second columns.

The first group of passages may have: a) a larger number of passages; and/or b) a greater volume; and/or c) denser fins than the second group of passages in the subcooler.

According to another object of the invention, there is provided an air separation unit, for separating air by cryogenic distillation, having a first column operated under a first pressure and a second column operated under a relatively lower second pressure, a condensation evaporator disposed on top of the first column and a pure nitrogen column connected to the top of the second column and having a smaller diameter than the second column, a main compressor, an air purification and cooling system, a first heat exchanger, an expander and a conduit conveying system for compressing, purifying, and cooling the feed air, and transferring it to at least the first column, a subcooler for indirect heat exchange between fluids to be cooled which are the oxygen enriched liquid air, waste liquid nitrogen and pure liquid nitrogen produced from the first column and fluids to be warmed which are low pressure pure nitrogen and waste nitrogen produced from the second column, the subcooler comprising a first group of passages, switchable means for sending either the waste liquid nitrogen or the pure liquid nitrogen to the first group of passages, a second group of passages, switchable means for sending either the pure liquid nitrogen or the waste liquid nitrogen to the second group of passages, the total heat exchange area of the first group of passages being greater than the total heat exchange area of the second group of passages.

The air separation unit may comprise means for sending part of the feed air to the first heat exchanger, a second heat exchanger, means for sending part of the feed air to the second heat exchanger, means for dividing into two fractions the cooled pure nitrogen from the second column downstream of the subcooler and means for sending one fraction of the pure nitrogen to be warmed in the first heat exchanger and another fraction of the pure nitrogen to be warmed in the second heat exchanger.

According to a still further object of the invention, there may be provided an air separation unit, for separating air by cryogenic distillation, having a first column operated under a first pressure and a second column operated under a relatively lower second pressure, a condensation evaporator disposed on top of the first column and a pure nitrogen column connected to the top of the second column and having a smaller diameter than the second column, a main compressor, an air purification and cooling system, a first heat exchanger, an expander and a conduit conveying system for compressing, purifying, and cooling the feed air, and transferring it to at least the first column, a subcooler for indirect heat exchange between fluids to be cooled which are the oxygen enriched liquid air, waste liquid nitrogen and pure liquid nitrogen produced from the first column and fluids to be warmed which are low pressure pure nitrogen and waste nitrogen produced from the second column, and a second heat exchanger for warming pure nitrogen from the second column downstream of the subcooler, the only streams exchanging heat in the second heat exchanger being air to be distilled in the first column and pure nitrogen from the second column.

During the switching of conduits, the conduits shall be switched at a distance as small as possible, but not less than 100 mm, away from the outer surfaces of the first and second columns.

Following the revamping process disclosed by the present invention, a suitable revamping process can be selected stepwise according to the desired increase of low pressure pure nitrogen production, and based on comprehensive comprehension of various factors such as the influence of increased production on the production capacity of the pure nitrogen column, the pressure drop of the column, the flow capacity of the conduit, the load and balance of the subcooler and main heat exchanger, as well as the load of the air compressor, thereby reducing the waste nitrogen production, increasing the low pressure pure nitrogen production, and realizing a stable and efficient operation of the air separation unit at a low energy consumption while spending minimum capital and operation expenditures.

DESCRIPTION OF THE DRAWINGS

The drawings in the present disclosure are merely illustrative of the present invention for the purpose of understanding and explaining the spirit of the invention, but are not to be construed as limiting the invention in any way.

DETAILED DESCRIPTION

In the present disclosure, the term "feed air" refers to a mixture comprising primarily oxygen and nitrogen. The term "low pressure pure nitrogen" covers a gaseous fluid having a nitrogen content of not less than 99 mole % and a pressure of less than 1.5 Bar A; the term "waste nitrogen" covers a gaseous fluid having a nitrogen content of not less than 95 mole % and a pressure of less than 1.5 Bar A, and the "waste nitrogen" has a lower nitrogen content than "low pressure pure nitrogen".

The term "oxygen enriched liquid air" refers to a liquid fluid having an oxygen molar percentage of greater than 30, the term "pure liquid oxygen" covers a liquid fluid having an oxygen molar percentage of greater than 70 and the "pure liquid oxygen" has a higher oxygen content than "oxygen enriched liquid air".

The term "pure liquid nitrogen" refers to a liquid fluid having a nitrogen molar percentage of greater than 99, the term "waste liquid nitrogen" refers to a liquid fluid having a nitrogen molar percentage of greater than 96, and the "waste liquid nitrogen" has a lower nitrogen content than "pure liquid nitrogen".

The cryogenic distillation of the present disclosure is a distillation process carried out at least partially at a temperature of 150 K or less. The term "column" as used herein refers to a distillation or fractionation column or zone, in which the liquid phase is contacted in countercurrent with the gas phase to effectively separate the fluid mixture. According to the present disclosure, "first column" is generally operated at a pressure of 5~6.5 Bar A, higher than "second column" which is generally operated at a pressure of 1.1~1.5 Bar A. The second column can be mounted vertically on top of the first column or the two columns can be installed side by side. The condensation evaporator on top of the first column refers to a heat exchange device that produces vapor from the liquid in the column. The top section of the second column, referred to as "pure nitrogen column" according to the present disclosure, has a reduced cross-section with respect to the rest of the second column, and is fully interconnected with the rest of the second column without partition.

Figure 1:
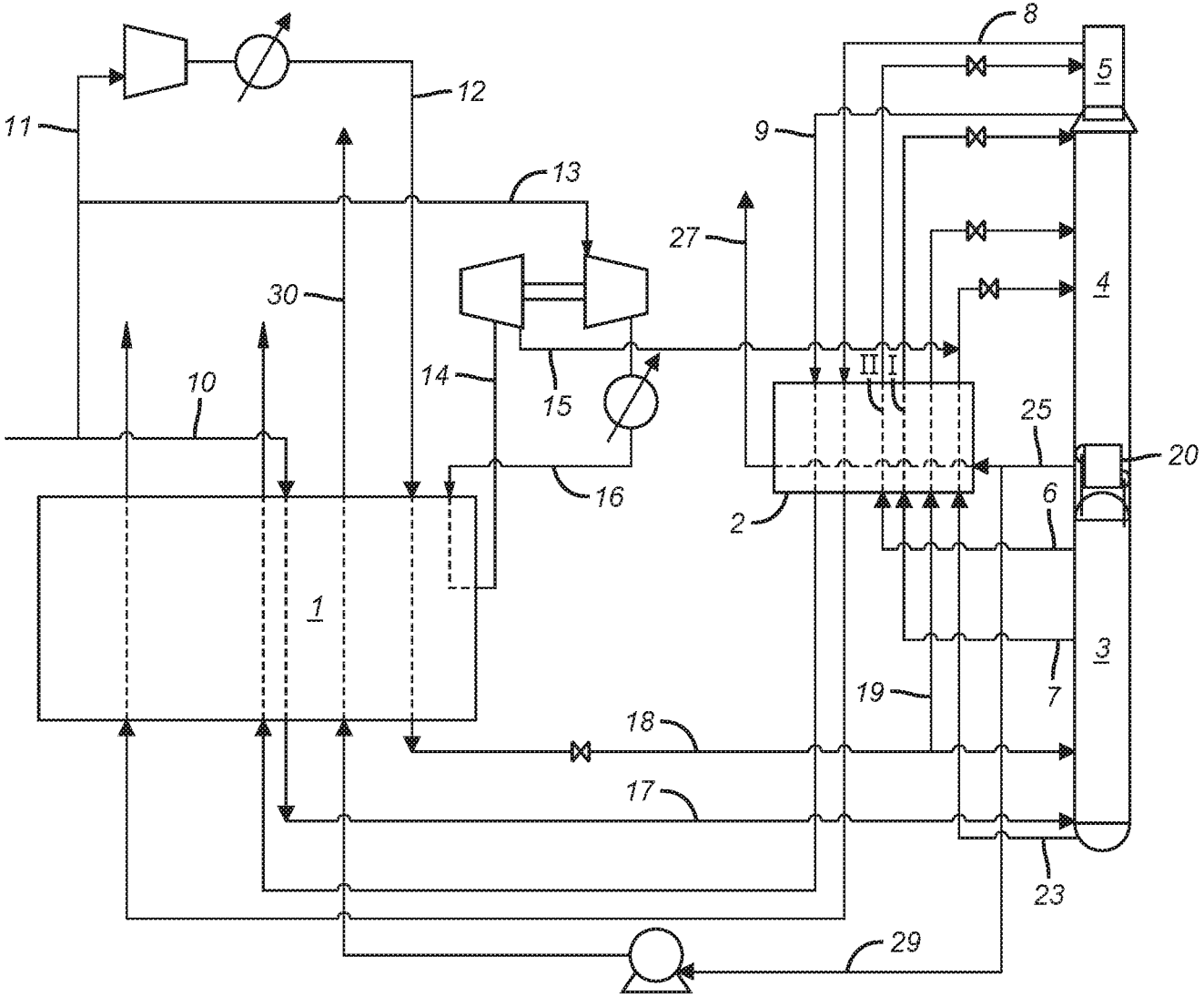
FIG. 1 is a schematic diagram of an apparatus for the separation of air by cryogenic distillation before revamping.

The general process for the production of nitrogen in two pressure air separation columns is as shown in FIG. 1: a portion 10 of the medium pressure air, which has been subjected to preliminary cooling, pressurization and purification of water and carbon dioxide and has a pressure of about 5.5 Bar A, is heat exchanged in the main heat exchanger 1 with such streams as the low pressure pure nitrogen 8, the waste nitrogen 9 that have been warmed in the subcooler 2, and the liquid oxygen 29 that has been pressurized by a liquid oxygen pump, to form feed air 17 to feed the first column and transfer it to the bottom of the first column 3. Another portion of the medium pressure air is further divided into two streams 11 and 13, wherein 11 is compressed into a stream 12 having a pressure of about 26 Bar A, cooled in the main heat exchanger 1 into a stream 18, a portion of 18 is transferred to the lower part of the first column 3, another portion 19 is cooled in the subcooler 2 and transferred to the upper part of the second column 4.

The stream 13 is fed to the compression end of the expansion compressor and is compressed into a stream 16 having a pressure of 12 Bar A, which is partially cooled in the main heat exchanger 1 to form a stream 14 and fed to the expansion end of the above expansion compressor, giving a stream 15 after the expansion. The feed air 17 and a portion of 18 are separated in the column 3 into a pure liquid nitrogen 6 that is withdrawn from the top of the column 3, a waste liquid nitrogen 7 that is withdrawn from the middle of the column 3, and an oxygen enriched liquid air 23 that is withdrawn from the bottom of the column 3. Said pure liquid nitrogen 6 and waste liquid nitrogen 7 are respectively passed through the passages II and passages I in the subcooler 2, expanded by a throttle valve and then into an upper part of the pure nitrogen column 5 and an upper part of the second column 4 at a position that is slightly lower than the pure nitrogen column 5, producing a low pressure pure nitrogen 8 having a pressure of about 1.2 Bar A on top of the pure nitrogen column 5, and a waste nitrogen 9 having a pressure of about 1.2 Bar A on top of the second column 4 at a position that is close to the pure nitrogen column 5. After being subcooled in the subcooler 2, the oxygen enriched liquid air 23 is mixed with the air stream 15 and transferred to the middle of the second column 4. The low pressure pure nitrogen 8 and waste nitrogen 9 are respectively warmed in the subcooler 2, and further fed into the main heat exchanger 1 for indirect heat exchange with various streams. The subsequent low pressure pure nitrogen can be stored as product or directly delivered to clients, the "waste" nitrogen can also be used as product, or used in the regenation in the air purification adsorbent apparatus, the pre-cooling of the pre-cooling system, or is directly discharged into the atmosphere.

The liquids within the second column 4 are fed to the condensation evaporator 20 disposed on top of the first column and then distilled to produce a liquid oxygen 25 at the outlet of the main condenser, wherein one portion thereof is subcooled in the subcooler 2 and output as a liquid oxygen product 27, in the case where a liquid oxygen product is produced, while another portion 29 is directly pressurized via a liquid oxygen pump and warmed in the main heat exchanger 1, and finally output as a gaseous pure oxygen product 30.

In the use of heat exchangers including the subcooler, the end that is in connection with streams of lower temperatures is called a cold end, while the end that is in connection with streams of higher temperatures is called a hot end.

The first group of passages I has: a) a larger number of passages; and/or b) a greater volume; and/or c) denser fins than the second group of passages II in the subcooler 2.

The total heat exchange area of the first group of passages I is greater than the total heat exchange area of the second group of passages II.

The design specifications of the column 3 comprise the column height, diameter, the number of packing layers, the type of packing, etc., which determine the maximum capacity thereof in air separation. For a given amount of feed air, the total flow rate of the two streams produced by the column 3, i.e., waste liquid nitrogen 7 and pure liquid nitrogen 6, is substantially constant, but the ratio between the two streams can be adjusted within a relatively wide range.

Similarly, the total flow rate of the two streams produced by the second column 4, i.e., low pressure pure nitrogen 8 and waste nitrogen 9, is substantially constant, but the ratio between the two streams can also be adjusted within a relatively wide range. For example, if more pure liquid nitrogen 6 is withdrawn from the outlet of pure liquid nitrogen 6 at the upper position, then the amount of waste liquid nitrogen 7 from the outlet of waste liquid nitrogen 7 at the lower position will be correspondingly reduced. Moreover, when more pure liquid nitrogen 6 is refluxed into the pure nitrogen column 5, more low pressure pure nitrogen 8 will be theoretically produced, and the amount of waste nitrogen 9 produced from the second column 4 will be correspondingly reduced.

However, for a set of cryogenic distillation apparatus, the highest yield of low pressure pure nitrogen and waste nitrogen and their ratio are already determined in the stage of apparatus design and construction. Moreover, in order to save investment and operating costs, the maximum capacity, size, material selection and the like for each component in the apparatus are all designed to meet the highest requirement as far as possible, leaving little room for adjustment. For example, a common situation is that the operation flexibility of a column can cover a 5% increase in yield; the heat exchange devices such as subcooler and main heat exchanger are generally aluminum plate-fin heat exchangers, for which a margin of 10% is generally left in designing the flow of passages and the heat exchange capacity thereof; the flux of conduits is proportional to the square of the diameter of the conduits, and is generally chosen from the commercially available models. The throttle valve is also selected to be matched as well as possible to the throttling flow.

Therefore, if it is intended to increase the production of low pressure pure nitrogen significantly in an existing cryogenic distillation apparatus, one may encounter the following problems: the original pure nitrogen column does not have sufficient capacity to produce the desired low pressure pure nitrogen; when the flow rate of pure liquid nitrogen used for producing low pressure pure nitrogen after revamping increases, the flow rate of waste liquid nitrogen after revamping will be correspondingly reduced, which may result in an imbalance in the subcooler; the increased flow rate of low pressure pure nitrogen from the second column after revamping may result in an exponential increase of the frictional pressure drop in the main heat exchanger, so that the pressure within the second column is remarkably increased, requiring an overload operation of the main air compressor; when the flow rate of pure liquid nitrogen after revamping increases significantly, this may exceed the maximum flux of the original conduit used for transporting original pure liquid nitrogen and the throttle capacity of the original throttle valve.

According to the low pressure pure nitrogen production after revamping as well as the influence thereof on the operation capacity and function of each part in the original cryogenic distillation apparatus, the present disclosure provides a stepwise revamping solution to the original cryogenic distillation apparatus.

Figure 2:
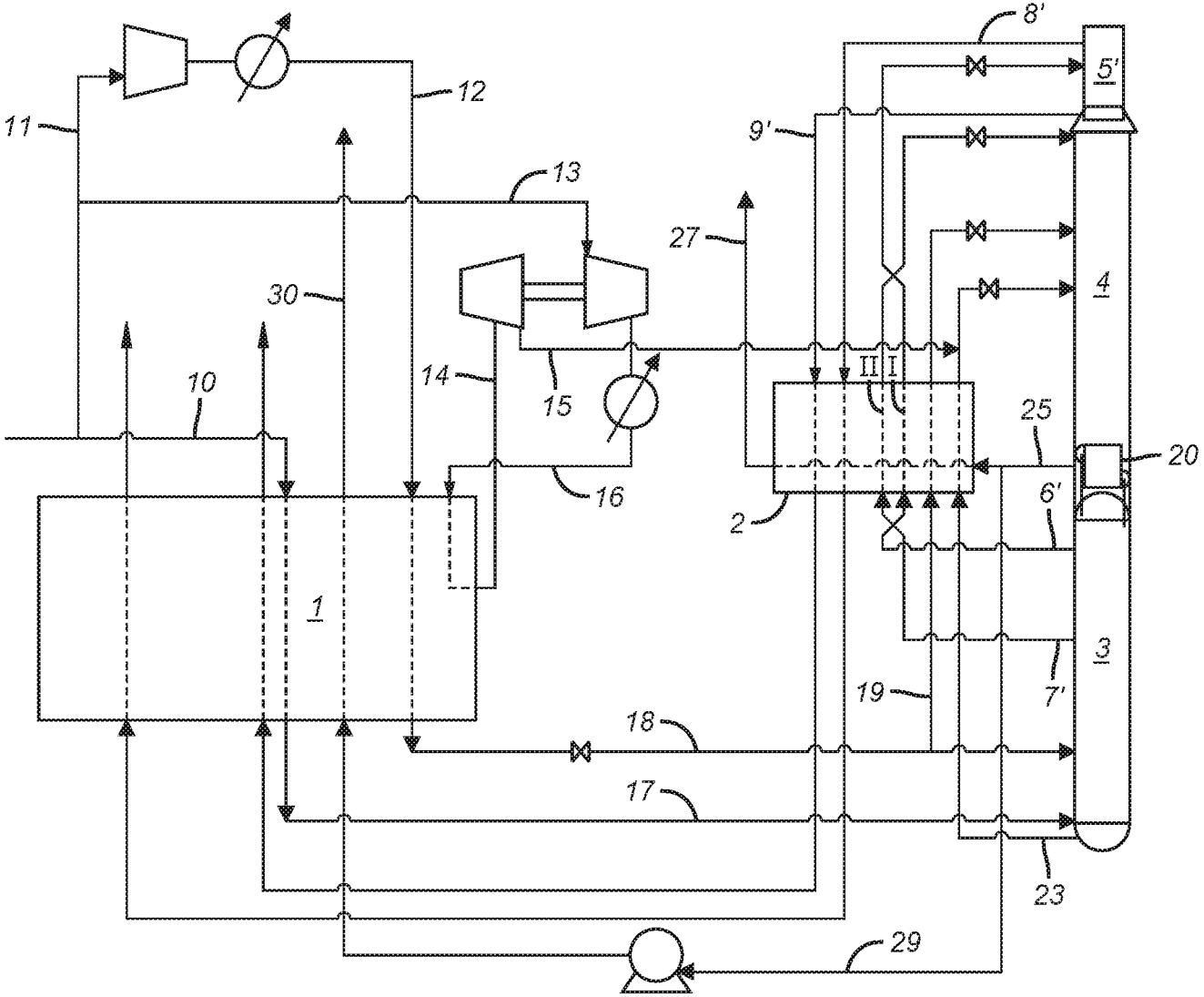
FIG. 2 is a schematic diagram of one embodiment of the present invention, in which the conduits through which the waste liquid nitrogen after revamping and the pure liquid nitrogen after revamping are passed in the subcooler have been switched.

The revamping process as shown in FIG. 2 may be employed when the flow rate of the pure liquid nitrogen 6' after revamping does not exceed the maximum flux of the original conveying conduit and the production of the low pressure pure nitrogen 8' after revamping has no negative impact on the heat exchange effect on the subcooler 2 and main heat exchange 1. In said process, the diameter and/or height of the original pure nitrogen column 5 can be increased to improve the production capacity of said column, and the height and/or diameter of the revamped pure nitrogen column 5' can be calculated according to the desired yield of low pressure pure nitrogen 8' after revamping. Alternatively, or additionally, an additional pure nitrogen column can be added, the additional column being connected in parallel with the original pure nitrogen column so as to increase the overall capacity.

However, in the case where the original pure nitrogen column is modified, the pure liquid nitrogen 6' used as reflux in the revamped pure nitrogen column 5' after revamping is only a portion of the reflux liquid in the second column 4, thus the diameter of the revamped pure nitrogen column 5' is still less than the diameter of the second column 4. The original subcooler 2 comprises a first group of passages I used to cool the original waste liquid nitrogen 7 and a second group of passages II used to cool the original pure liquid nitrogen 6, with the first group of passages I having a larger total heat exchange area than that of the second group of passages II. Since the flow rate of pure liquid nitrogen 6' after revamping increases and requires a larger heat exchange area, the conduits at the inlet and outlet of the subcooler 2 may be switched, allowing the pure liquid nitrogen 6' to be cooled in the first group of passages I in the subcooler 2 after revamping, and the waste liquid nitrogen 7' to be cooled in the second group of passages II in the subcooler 2 after revamping.

In other words, assuming that before revamping, the original waste liquid nitrogen 7 is in connection with the inlet of the first group of passages I in the subcooler via a conduit having a diameter D, and the original pure liquid nitrogen 6 is in connection with the inlet of the second group of passages II in the subcooler via a conduit having a diameter d, then during revamping, the conduit having a diameter D is made to be in connection with the inlet of the second group of passages II in the subcooler, and the conduit having a diameter d is made to be in connection with the inlet of the first group of passages I in the subcooler.

Likewise, if before revamping, the outlet of the first group of passages I in the subcooler is in connection with the conduit having a diameter D', and the outlet of the second group of passages II in the subcooler is in connection with the conduit having a diameter d', then during revamping, the conduit having a diameter D' is made to be in connection with the outlet of the second group of passages II in the subcooler, and the conduit having a diameter d' is made to be in connection with the outlet of the first group of passages I in the subcooler. During revamping, a variable diameter connector can be used to connect conduits of different diameters.

The original apparatus of FIG. 1 may be constructed with the revamping process already planned. Thus the waste liquid nitrogen may be originally connected to both first and second groups of passages, the waste nitrogen being actually sent to the first group before revamping and the second group after revamping, the only operation being required to alter the destination of the waste nitrogen being to switch the conduits.

Similarly, the pure liquid nitrogen may be originally connected to both first and second groups of passages, the pure liquid nitrogen being actually sent to the second group before revamping and the first group after revamping, the only operation being required to alter the destination of the pure liquid nitrogen being to switch the conduits.

Figure 3:
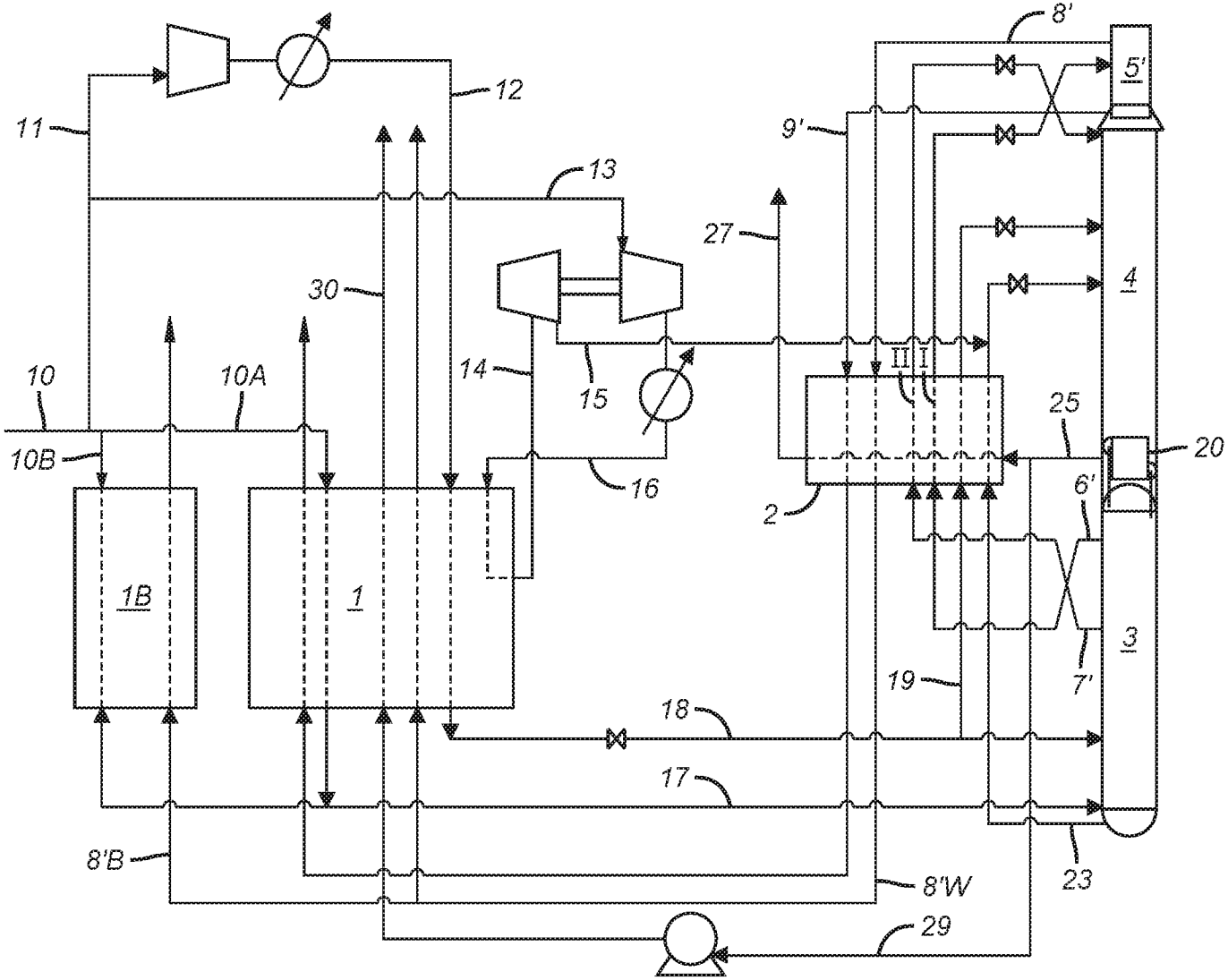
FIG. 3 is a schematic diagram of another embodiment of the present invention, which comprises not only switching the conduits through which the waste liquid nitrogen after revamping and the pure liquid nitrogen after revamping are passed in the subcooler, but also switching the main parts of the conduits which transfer the waste liquid nitrogen after revamping and the pure liquid nitrogen after revamping, and adding an additional heat exchanger.

The revamping process as shown in FIG. 3 may be employed when the increased flow rate of the pure liquid nitrogen 6' after revamping exceeds the maximum flux of the original conveying conduit and the production of the low pressure pure nitrogen 8' after revamping has impact on the heat exchange effect on the main heat exchange 1. In said process, the diameter and/or height of the original pure nitrogen column 5 can be increased to improve the production capacity of said column, and the height and/or diameter of the revamped pure nitrogen column 5' can be calculated according to the desired yield of low pressure pure nitrogen 8' after revamping.

The conduits used for transporting the waste liquid nitrogen 7' after revamping and the pure liquid nitrogen 6' after revamping are switched near the bodies of the first column 3 and second column 4. To be specific, the pure liquid nitrogen 6' from the column 3 after revamping is passed through a conduit d having a smaller diameter, switched to a conduit D having a bigger diameter and into a first group of passages I having a larger heat exchange area in the subcooler 2, and then is further passed through a conduit D' having a bigger diameter, a throttle valve which matches D', and is finally switched to a conduit d' having a smaller diameter and passed into the middle of the revamped pure nitrogen column 5'; after revamping, the waste liquid nitrogen 7' from the column 3 is passed through a conduit D having a bigger diameter, switched to a conduit d having a smaller diameter and into a second group of passages II having a smaller heat exchange area in the subcooler 2, and then is further passed through a conduit d' having a smaller diameter, a throttle valve which matches d', and is finally switched to a conduit D' having a bigger diameter and passed into the upper part of the second column 4 at a position that is slightly lower than the revamped pure nitrogen column 5'.

During switching of the conduits, a variable diameter connector can be used to connect conduits of different diameters, the position of the switch shall be as close as possible to the body of the column as long as the sealability of the column is not affected, and is generally at a distance of 100 mm away from the outer surface of the column.

The revamping process of FIG. 3 further comprises an added additional heat exchanger 1B. After revamping, the low pressure pure nitrogen 8' is warmed by the subcooler and formed as a stream 8'W, which is subsequently divided into a stream 8'A and a stream 8'B, wherein the flow rate of 8'A is approximately equivalent to the flow rate of the original low pressure pure nitrogen 8, and fed into the main heat exchanger 1 via the original conduit, the increased low pressure pure nitrogen is formed as a stream 8'B, and fed into the cold end of the additional exchanger 1B. The original medium pressure feed air 10 is also correspondingly divided into two streams 10A and 10B, wherein 10A is fed into the hot end of the main heat exchanger 1 via the original conduit, while 10B is made to enter the hot end of the additional heat exchanger 1B. The flow rate of 10B is determined by 8'B, and the ratio of 10A to 10B is approximately 7:3. The increased flow rate of the low pressure pure nitrogen 8' after revamping may result in a corresponding reduction in the flow rate of the waste nitrogen 9' after revamping, thus in the main heat exchanger 1 and additional heat exchanger 1B, the stream distribution after revamping can still ensure a balance between the two heat exchangers.

The following Example 1 corresponds to an apparatus for the separation of air by cryogenic distillation having an oxygen production of 60000 $Nm^3/h$. The original low pressure pure nitrogen production of the apparatus is 40200 $Nm^3/h$, and after revamping, the production of low pressure pure nitrogen shall be almost doubled. The revamping is carried out according to the process as shown in FIG. 3. The original pure nitrogen column 5 has the following parameters: diameter 2 m, height 4 m, and after revamping, 5' has the following parameters: diameter 2.75 m, height 5.1 m. Table 1 compares the flow rate, pressure and temperature parameters of the four streams before and after revamping. It can be seen that on the premise of increasing the production of low pressure pure nitrogen by more than one time from 40200 $Nm^3/h$ to 80800 $Nm^3/h$, the pressure and temperature parameters of each stream obtained by using the revamping process of the present invention are almost the same as those existing before revamping, indicating that the operation of the apparatus for the separation of air by cryogenic distillation is not adversely affected at all.

TABLE 1

Comparison of stream parameters before and after switching

| | Pure liquid nitrogen 6 | | Waste liquid nitrogen 7 | | Low pressure pure nitrogen 8 | | Waste nitrogen 9 | |
|---|---|---|---|---|---|---|---|---|
| | Before revamp | After revamp | Before revamp | After revamp | Before revamp | After revamp | Before revamp | After revamp |
| Flow rate ($Nm^3/h$) | 29100 | 49500 | 44000 | 17200 | 40200 | 80800 | 174800 | 135900 |
| Pressure (Bar A) | 5.50 | 5.40 | 5.52 | 5.42 | 1.33 | 1.33 | 1.35 | 1.35 |
| Temperature (° C.) | −177.9 | −177.9 | −177.8 | −177.8 | −193.4 | −193.4 | −192.8 | −192.8 |

TABLE 2

Comparison of un-switched stream parameters before and after revamping

| | Feed air 17 to first column | | Oxygen enriched liquid air 23 | | Liquid oxygen 25 from outlet of main condenser | | Liquid oxygen product 27 | |
|---|---|---|---|---|---|---|---|---|
| | Before revamp | After revamp | Before revamp | After revamp | Before revamp | After revamp | Before revamp | After revamp |
| Flow rate ($Nm^3/h$) | 174700 | 179000 | 108700 | 114000 | 61100 | 61100 | 1000 | 1000 |
| Pressure (Bar A) | 5.54 | 5.54 | 5.54 | 5.54 | 1.45 | 1.45 | 1.41 | 1.41 |
| Temperature (° C.) | −168.8 | −168.8 | −173.7 | −173.7 | −179.4 | −179.4 | −184.0 | −184.0 |

Table 2 compares the flow rate, pressure and temperature parameters of the un-switched other main streams before and after revamping. It can be seen that the flow rate, pressure and temperature parameters of each stream are almost the same as those existing before revamping, indicating that the operation of the apparatus for the separation of air by cryogenic distillation is not adversely affected at all by the revamping process.

Table 3 lists the flow rate distribution of the medium pressure air 10' and low pressure pure nitrogen 8'W between the main heat exchanger 1 and the additional heat exchanger 1B, as well as their corresponding pressure and temperature after revamping and also provides a comparison thereof with the corresponding parameters in the original medium pressure air 10 and the low pressure pure nitrogen 8 having been warmed in the subcooler before revamping.

TABLE 3

Distribution of streams in the main heat exchanger and additional heat exchanger before and after revamping and the parameters thereof

| | | Before revamp | | After revamp | |
|---|---|---|---|---|---|
| | | Medium pressure air 10 | Low pressure pure nitrogen 8 after warming | Medium pressure air 10A | Low pressure pure nitrogen 8'A |
| Main heat exchanger 1 | Flow rate ($Nm^3/h$) | 174700 | 40200 | 140700 | 40000 |
| | Pressure (Bar A) | 5.74 | 1.33 | 5.74 | 1.28 |
| | Temperature (° C.) | 34.5 | −176.1 | 34.4 | −176.1 |

| | | Medium pressure air 10B | Low pressure pure nitrogen 8'B |
|---|---|---|---|
| Additional heat exchanger 1B | Flow rate ($Nm^3/h$) | 38300 | 40800 |
| | Pressure (Bar A) | 5.74 | 1.28 |
| | Temperature (° C.) | 34.4 | −176.1 |

The above is an example for realizing the present invention, but the present invention-creation is not limited to the example described above, and various equivalent variations or replacements made by those skilled in the art in accordance with the present disclosure shall all fall within the scope as defined by the claims of the present invention.

What is claimed is:

1. A process of revamping an original apparatus for the separation of air by cryogenic distillation so as to increase the production of low pressure pure nitrogen, the original apparatus for the separation of air by cryogenic distillation comprising:

a. a first column operated under a first pressure and a second column operated under a relatively lower second pressure, a condensation evaporator disposed on top of the first column and an original pure nitrogen column connected to a top of the second column and having a smaller diameter than the second column, b. a main compressor, an air purification and cooling system, a main heat exchanger, an expander and a conduit conveying system for compressing, purifying, and cooling feed air, and transferring said feed air to at least the first column, c. a subcooler for indirect heat exchange between fluids to be cooled, which comprise an oxygen enriched liquid air, original waste liquid nitrogen and original pure liquid nitrogen produced from the first column and possibly pure liquid oxygen from the second column, and fluids to be warmed, which comprise the original low pressure pure nitrogen and original waste nitrogen produced from the second column, the subcooler comprising a first group of passages through which the original waste liquid nitrogen is passed and a second group of passages through which the original pure liquid nitrogen is passed, and the total heat exchange area of the first group of passages being greater than the total heat exchange area of the second group of passages, d. a first conduit having a diameter D that transfers the original waste liquid nitrogen from the first column to the first group of passages in the subcooler and a second conduit having a diameter D' that transfers the original waste liquid nitrogen from the first group of passages in the subcooler to an upper part of the second column as well as a third conduit having a diameter d that transfers the original pure liquid nitrogen from the first column to the second group of passages in the subcooler and a fourth conduit having a diameter d' that transfers the original pure liquid nitrogen from the second group of passages in the subcooler to the top of original pure nitrogen column, wherein D>d, D'>d', wherein the process comprises the steps of:

substituting the original pure nitrogen column with a revamped pure nitrogen column having an increased diameter and/or height as compared to the original pure nitrogen column to thereby improve the production capacity of the low pressure pure nitrogen in the revamped pure nitrogen column and/or installing an additional pure nitrogen column in parallel to the original pure nitrogen column in order to improve the overall production capacity; and physically switching the first and third conduits having diameters D and d at a hot end of the subcooler, and physically switching the second and fourth conduits having diameters D' and d' at a cold end of the subcooler, thereby allowing the pure liquid nitrogen after revamping to be passed through the first group of passages in the subcooler, and the waste liquid nitrogen after revamping to be passed through the second group of passages in the subcooler.

2. The revamping process according to claim 1, further comprising the steps of:

adding an additional heat exchanger; and dividing the low pressure pure nitrogen after revamping that has been warmed in the subcooler into two portions, with the first portion entering the cold end of the original main heat exchanger and the second portion entering the cold end of the additional heat exchanger, and also dividing the pressurized and purified air into two portions, with the first portion entering the hot end of the original main heat exchanger and the second portion entering the hot end of the additional heat exchanger, and being respectively subjected to indirect heat exchange with the first and second portions of the low pressure pure nitrogen after revamping.

3. The revamping process according to claim 1, wherein during the step of physically switching the first and third conduits having diameters D and d at a hot end of the subcooler, and physically switching the second and fourth conduits having diameters D' and d' at a cold end of the subcooler the waste liquid nitrogen from the first column after revamping is passed successively through the first conduit having a diameter D, the third conduit having a diameter d, the second group of passages in the subcooler, the fourth conduit having a diameter d', a first throttle valve, the second conduit having a diameter D', and finally to the upper part of the second column, and the pure liquid nitrogen from the first column after revamping is passed successively through the third conduit having a diameter d, the first conduit having a diameter D, the first group of passages in the subcooler, the second conduit having a diameter D', a second throttle valve, the fourth conduit having a diameter d', and finally to the top of the pure nitrogen column.

4. The revamping process according to claim 3, wherein the first and second conduits are switched at a distance of not less than 100 mm away from an outer surface of the first column, wherein the third and fourth conduits are switched at a distance of not less than 100 mm away from the second columns.

5. The revamping process according to claim 1, wherein the first group of passages has: a) a larger number of passages; and/or b) a greater volume; and/or c) denser fins than the second group of passages in the subcooler.

6. A process for revamping an existing apparatus for the separation of air by cryogenic distillation so as to increase the production of low pressure pure nitrogen, the original apparatus for the separation of air by cryogenic distillation comprising:

a. a first column operated under a first pressure and a second column operated under a relatively lower second pressure, a condensation evaporator disposed on top of the first column and an original pure nitrogen column connected to a top of the second column and having a smaller diameter than the second column, b. a main compressor, an air purification and cooling system, a main heat exchanger, an expander and a conduit conveying system for compressing, purifying, and cooling feed air, and transferring said feed air to at least the first column, c. a subcooler for indirect heat exchange between fluids to be cooled, which comprise an oxygen enriched liquid air, a waste liquid nitrogen and a pure liquid nitrogen produced from the first column, and fluids to be warmed, which comprise a low pressure pure nitrogen and a waste nitrogen produced from the second column, the subcooler comprising a first group of passages through which a flow of the waste liquid nitrogen is passed and a second group of passages through which a flow of the pure liquid nitrogen is passed, wherein the first group of passages has a higher thermal capacity as compared to the second group of passages, wherein the process comprises the steps of:

substituting the original pure nitrogen column with a revamped pure nitrogen column having an increased diameter and/or height as compared to the original pure nitrogen column to thereby improve the production capacity of the low pressure pure nitrogen in the revamped pure nitrogen column and/or installing an additional pure nitrogen column in parallel to the original pure nitrogen column in order to improve the overall production capacity; and altering the flow of the waste liquid nitrogen and the pure liquid nitrogen such that the waste liquid nitrogen flows through the second group of passages instead of the first group of passages, and the pure liquid nitrogen flows through the first group of passages instead of the second group of passages.

7. The revamping process according to claim 6, wherein the first group of passages has a higher thermal capacity as compared to the second group of passages by the first group of passages having: a) a larger number of passages; and/or b) a greater volume; and/or c) denser fins than the second group of passages in the subcooler.

* * * * *